US009845171B2

(12) United States Patent
Conway et al.

(10) Patent No.: US 9,845,171 B2
(45) Date of Patent: Dec. 19, 2017

(54) ERGONOMICALLY ADVANTAGEOUS CONTAINER

(71) Applicant: S.C. Johnson & Son, Inc., Racine, WI (US)

(72) Inventors: Simon M. Conway, Burlington, WI (US); Linda J. Babinski, Kenosha, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 144 days.

(21) Appl. No.: 14/541,249

(22) Filed: Nov. 14, 2014

(65) Prior Publication Data

US 2015/0136779 A1 May 21, 2015

Related U.S. Application Data

(60) Provisional application No. 61/905,084, filed on Nov. 15, 2013.

(51) Int. Cl.

| | |
|---|---|
| ***B65D 41/04*** | (2006.01) |
| ***B65D 1/02*** | (2006.01) |
| ***B65D 21/02*** | (2006.01) |
| ***B65D 23/10*** | (2006.01) |
| ***B65D 25/28*** | (2006.01) |

(52) U.S. Cl.

CPC ..... *B65D 1/0246* (2013.01); *B65D 1/0284* (2013.01); *B65D 21/0231* (2013.01); *B65D 23/10* (2013.01); *B65D 25/2882* (2013.01); *B65D 41/04* (2013.01)

(58) Field of Classification Search

CPC .. B65D 1/0246; B65D 25/2882; B65D 41/04; B65D 1/0284; B65D 21/0231; B65D 23/10; B65D 23/108

USPC .... 220/696, 710.5, 741, 752, 753, 754, 755, 220/756, 757, 758, 768, 769, 770, 761, 220/771, 608, 669, 288; 206/499, 503, 206/508; 215/397, 398, 396; D9/532, D9/535, 531, 530; 16/430, 110.1

See application file for complete search history.

(56) References Cited

U.S. PATENT DOCUMENTS 3,805,995 A * 4/1974 Lebel ..... B65D 25/00 116/227
4,781,314 A * 11/1988 Schoonover ..... B65D 1/20 215/375

(Continued)

FOREIGN PATENT DOCUMENTS

GB 887893 1/1962

OTHER PUBLICATIONS

PCTUS2014065651 International Search Report and Written Opinion dated Jan. 28, 2015.

*Primary Examiner* — Kareen Thomas

(57) ABSTRACT

Containers are disclosed herein that include a reservoir, a handle disposed on the reservoir at an angle defined by a grip axis. The handle is configured for a single grip position and having a midpoint that coincides with a midpoint of a user's grip when the handle is gripped by a user. A first center of gravity coincident with a resting axis is substantially perpendicular to the bottom wall when the bottom wall is placed on a horizontal surface. A second center of gravity coincident with a carrying axis is substantially perpendicular to the grip axis when the container is carried by the handle.

19 Claims, 9 Drawing Sheets

(56) References Cited

U.S. PATENT DOCUMENTS

| | | | | | |
|---|---|---|---|---|---|
| 4,923,098 | A | * | 5/1990 | Schoonover | B65D 1/18 215/380 |
| 5,071,277 | A | * | 12/1991 | Braun | A45D 40/265 220/631 |
| 5,360,133 | A | * | 11/1994 | Corby | B29C 49/4802 215/374 |
| D418,759 | S | * | 1/2000 | Holmstrom | D9/528 |
| 6,053,401 | A | * | 4/2000 | Andrews, Sr. | B65D 81/3261 220/495.03 |
| D516,434 | S | * | 3/2006 | McGuire | D9/524 |
| D556,584 | S | * | 12/2007 | Dorn | D9/527 |
| D569,476 | S | * | 5/2008 | Munlin | D23/211.1 |
| 9,334,085 | B2 | * | 5/2016 | Persson | B65D 25/2885 |
| 2004/0099672 | A1 | | 5/2004 | Perlman | |
| 2005/0161423 | A1 | | 7/2005 | Pick | |
| 2008/0254245 | A1 | | 10/2008 | Penescu et al. | |
| 2011/0017625 | A1 | * | 1/2011 | Wycoff | B65D 1/0223 206/459.5 |
| 2012/0325866 | A1 | * | 12/2012 | Lee | B65D 25/42 222/466 |

* cited by examiner

ERGONOMICALLY ADVANTAGEOUS CONTAINER

CROSS REFERENCE TO RELATED APPLICATIONS

This application claims the benefit of U.S. Provisional Application Ser. No. 61/905,084, filed Nov. 15, 2013.

REFERENCE REGARDING FEDERALLY SPONSORED RESEARCH OR DEVELOPMENT

Not applicable

BACKGROUND OF THE INVENTION

1. Field of the Background

The present invention relates generally to containers for liquids, and more specifically, containers that are ergonomically advantageous to users.

2. Description of the Background

Various containers for liquids are known that generally include a reservoir that holds a liquid and a handle to facilitate carrying and dispensing of the liquid from the reservoir. These devices typically include a single, threaded pour spout and corresponding threaded cap to seal the container when not in use. Often handles are disposed either on the top of the containers to facilitate lifting or on a side of the container to facilitate pouring of the liquid therefrom. However, these types of handle placement present ergonomic problems to a user that cause difficulty for pouring and/or lifting of the container. Moreover, such problems are present throughout the use of the container from when full to when emptied. Similar difficulties may be also experienced when such containers are refilled. There is a need, therefore, for containers that allow a user to ergonomically handle the container both when lifting and carrying the container and when dispensing a liquid therefrom, as well as when there is a need to refill the container.

SUMMARY OF THE INVENTION

According to one aspect, a container includes a reservoir having a front wall, a rear wall, side walls, a bottom wall, and a top wall. The container further includes a handle disposed on the top wall at an angle defined by a grip axis, the handle being configured for a single grip position and having a midpoint that coincides with a midpoint of a user's grip when the handle is gripped by a user. In addition, the container includes a first center of gravity coincident with a resting axis that is substantially perpendicular to the bottom wall when the bottom wall is placed on a horizontal surface, and a second center of gravity coincident with a carrying axis that is substantially perpendicular to the grip axis when the container is carried by the handle.

According to a second aspect, a container includes a reservoir having a top wall, a handle disposed on the top wall at an angle defined by a grip axis, the handle being configured for a single grip position and having a midpoint that coincides with a midpoint of a user's grip when the handle is gripped by a user, a first center of gravity coincident with a resting axis that is substantially perpendicular to the bottom wall when the bottom wall is placed on a horizontal surface, and a second center of gravity coincident with a carrying axis that is substantially perpendicular to the grip axis when the container is carried by the handle. The second center of gravity remains substantially coincident with the carrying axis as the contents of the container are dispensed from the reservoir.

According to a third aspect, a container includes a reservoir having a front wall, a rear wall, side walls, a bottom wall, and a top wall. The container further includes a liquid comprised within the reservoir, a handle disposed on the top wall at an angle defined by a grip axis, the handle being configured for a single grip position and having a midpoint that coincides with a midpoint of a user's grip when the handle is gripped by a user, a threaded pour spout disposed on the top wall adjacent the handle, a cap disposed on the pour spout to provide a liquid impervious seal to the container, a first center of gravity coincident with a resting axis that is substantially perpendicular to the bottom wall when the bottom wall is placed on a horizontal surface, and a second center of gravity coincident with a carrying axis that is substantially perpendicular to the grip axis when the container is carried by the handle. The second center of gravity remains substantially coincident with the carrying axis as the contents of the container are dispensed from the reservoir.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

Figure 1:
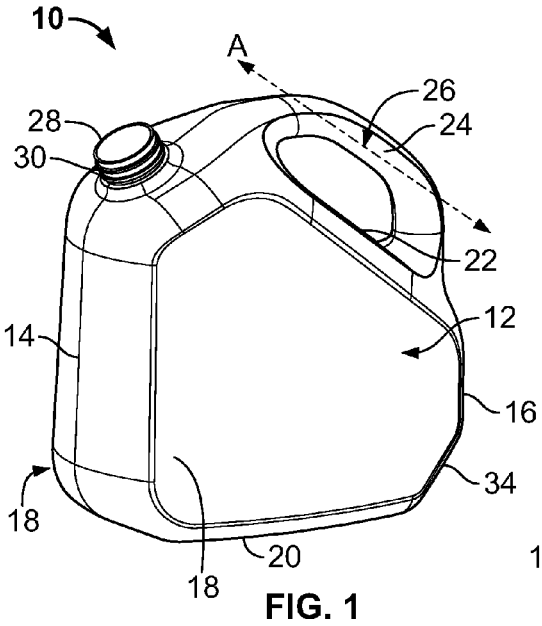
FIG. 1 is a front isometric view of a first embodiment of a container.

As depicted in FIGS. 1-4, a container 10 generally includes a reservoir 12, with a front wall 14, a rear wall 16, side walls 18, a bottom wall 20, and a top wall 22. The front wall 14, rear wall 16, side walls 18 and top wall 22 may each independently have a slightly convex and/or tapered shape, whereas the bottom wall 20 may be either flat or have a slight concave shape. The container further includes a handle 24 disposed on the top wall 22 at an angle defined by a grip axis A. The handle 24 is configured for a single grip position, such that a user when gripping the handle is able to grip the handle in a substantially single grip with the entire hand, rather than being able to grip the handle with the entire hand in two or more substantially different positions by sliding his grip along the handle in an upward or downward direction. The handle 24 further includes a midpoint 26 that coincides with a midpoint of a user's grip (not shown) when the handle is gripped by a user. The handle 24 may be hollow to help dispense a substance contained within the container 10 more efficiently and with reduced "glugging," which occurs when a liquid leaving a container intermittently blocks the exit through which it is leaving to prevent air from entering the container.

A pour spout 28 is disposed on the top wall 22 adjacent the handle 24 and extends from the top wall 22 to a height $H_1$ below a height $H_2$ that corresponds to that of an upper most portion of the handle 24. A distance $D_1$ is the distance between $H_1$ and $H_2$. The pour spout 28 may include threads 30 or other locking mechanisms known in the art that may be engaged by a cap 32 with complementary threads or other complementary locking mechanism (not shown) to provide a liquid impervious seal when screwed onto the pour spout. The cap 32 may be any shape and may be sized such that when affixed to the pour spout 28, a combined height of the pour spout and cap is equal to, less than, or greater than $H_2$.

Figure 4:
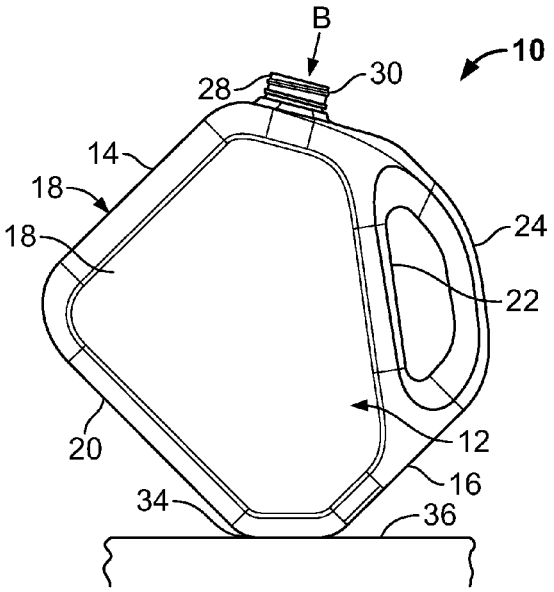
FIG. 4 is a left side elevational view of the container of FIG. 1 in a first state.

The reservoir 12 further includes a flat wall portion 34 disposed opposite of the pour spout 28. The wall portion 34 is configured to provide a stabilizing base to the container 10 during refilling of the reservoir 12. For example, as seen in FIG. 4, when a user wishes to add a substance, such as a liquid- or particulate-based substance to the reservoir 12, the container 10 may be placed on a horizontal surface 36 on wall portion 34, which positions the pour spout 28 in a generally vertical orientation to allow a substance to be poured or otherwise added from a direction B into the reservoir through the pour spout. When in this filling state, the user may more easily control the filling of the reservoir 12 because the container 10 is being maintained in a relatively steady state with little to no effort by the user. Thus, the user may fill the reservoir 12 without the need to hold onto the container 10 or with minimal steadying of the container. In another embodiment, the wall portion 34 may be varied in size relative to the bottom wall 20, such that it is similarly sized or larger to provide greater stability when filling the reservoir 12.

In one non-limiting form, the container 10 has a generally square outline of 9.25"×9.25" (23.5 cm×23.5 cm) with a 5" (12.7 cm) base and rounded slightly tapered sides.

The container 10 and/or cap 32 may each be independently made of any appropriate material, such as a polymer, a plastic, metal, glass, a cellulosic material, a laminated material, a recycled material, and combinations thereof. It is further envisioned that the container 10 may include an interior and/or exterior lining or coating to further strengthen the container structurally, as well as make the container resilient to harsh chemicals. The container may be opaque or minimally translucent to enable storage of light-sensitive materials. It is envisioned that such treatments may enable storage of most liquid- and/or particulate-based substances.

Containers 10 contemplated here may be of any volume (or weight) that would be carried by a single handled container, such as about 1 pint, or about 1 to about 3 quarts, or about 1 to about 5 gallons, or about 500 ml to about 1 liter, or about 2 to about 10 liters, or any volume in between. Containers 10 contemplated herein may also be of any shape, such as a diamond, a round or canteen shape, a spherical shape, a conical shape, a heart shape, a polyhedron shape, etc., while maintaining the principles of the present disclosure.

Figure 2:
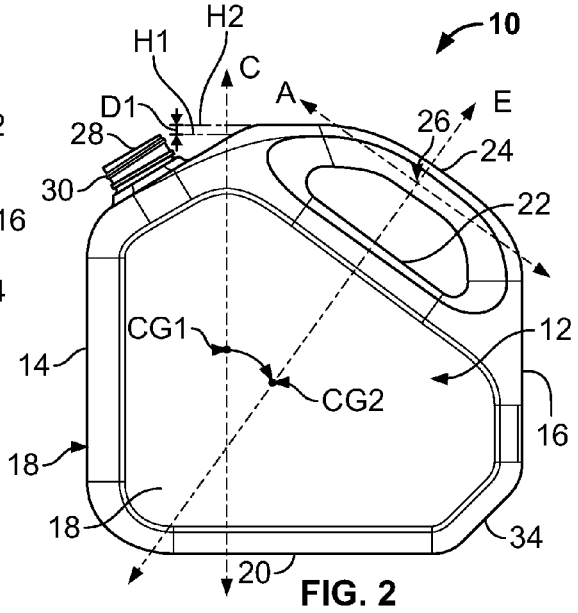
FIG. 2 is a left side elevational view of the container of FIG. 1, the right side being a mirror image thereof.
Figure 3:
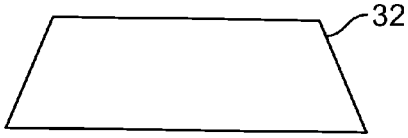
FIG. 3 is a front elevational view of a cap.

With reference to FIG. 2, the container 10 is further configured to have a first center of gravity CG1 that is coincident with a resting axis C, which is substantially perpendicular to the bottom wall 20 of the container when the bottom wall is placed on a horizontal surface (not shown). CG1 may be located higher or lower along axis C based on altering the relative profile of the container 10, where, for example, a more square shape and tapered walls provides a more stable architecture and lowers CG1 along axis C and a more rectangular straighter side wall configuration shifts CG1 upward along axis C.

Figure 5:
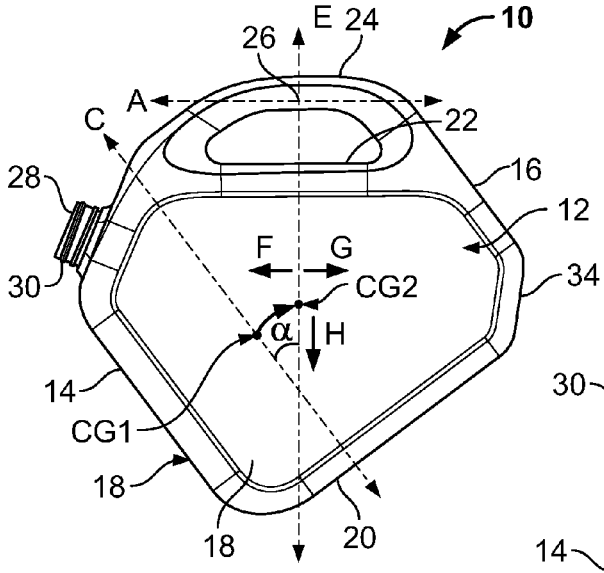
FIG. 5 is a left side elevational view of the container of FIG. 1 in a second state.

The container 10 further has a second center of gravity CG2 when the container is carried by the handle 24, as depicted in FIG. 5. The center of gravity shifts from CG1 to CG2 when the container 10 is supported by the handle 24 by a user. Moreover, center of gravity CG2 is coincident with a carrying axis E that extends from the midpoint 26 on grip axis A of the handle 24 in a substantial parallel direction with the force of gravity, which is substantially perpendicular to grip axis A. Axis C and axis E are separated by an angle a, which may range from about 1 degree to about 90 degrees, or about 5 degrees to about 80 degrees, or about 10 degrees to about 70 degrees, or about 15 to about 60 degrees, or may be about 25 degrees, or about 35 degrees, or about 45 degrees.

The configuration of the container 10 enables the center of gravity from CG1 to shift to CG2 when a user lifts the container by the handle and minimizes the torsional exertion necessary to use the container. In other words, by balancing the weight of the container 10 along the carrying axis E, the user expends less effort to pour contents from the container and hold the container compared to a container (not shown) with a center of gravity shifted forward (arrow F) or backward (arrow G) relative to the carrying axis E. Further, less shoulder, arm, wrist, and/or hand stress or strain is experienced by a user when employing the present container 10 compared to conventional containers. The present container 10, therefore, provides improved user experience with improved ergonomics compared to similar containers.

Due to the configuration of the container 10, the second center of gravity CG2 remains substantially coincident with the carrying axis E as the contents of the container are dispensed over time. Rather than shifting forward or backward relative to the carrying axis E, the center of gravity CG2 merely shifts downward as the contents of the container 10 decrease in a downward direction (arrow H) when the container is held in the carrying position, as shown in FIG. 5. This characteristic of the container 10 is realized insofar as a pourable level of the contents therein may be dispensed from the opening of the pour spout 28. It is contemplated that the container 10 may be fashioned in such a manner that the pour spout 28 may be positioned higher or lower relative to the carrying axis E to facilitate dispensing.

While the contents of the container 10 are being dispensed, however, the center of gravity CG2 may move forward and backward relative to the carrying axis E. Even so, it is believed that the overall distance the center of gravity travels when the container 10 transitions from a carrying position to a dispensing position is less than in containers lacking a center of gravity that remains coincident with a carrying axis of the container as container contents are dispensed over time. Therefore, a user experiences decreased torsional forces by using the present container relative to other containers lacking centers of gravity that remain coincident with a carrying axis. It follows that the present container 10 exhibits improved ergonomic efficiency relative to such other containers.

Figure 6:
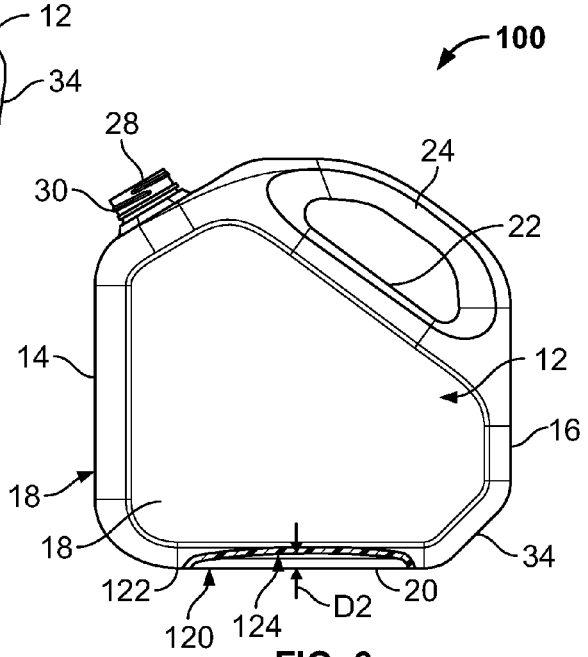
FIG. 6 is a left side partial cut away elevational view of a second embodiment of a container.

In another embodiment shown in FIG. 6, a container 100 includes a bottom wall 20 with a concave central portion 120 that is configured to nest with the top wall 20 of a second container (not shown) to allow the containers to be stacked on top of one another. In one embodiment a depth $D_2$, which is measured between a bottommost surface 122 of the container 100 and the apex 124 of the concave central portion 120, is less than distance $D_1$ such that the weight of an upper container stacked on a lower container is not sustained by the cap (not shown) and pour spout 28 but rather by only the top surface 20. Conversely, in a further embodiment, the cap 34 may be sized and configured to provide a larger surface area for an upper container stacked on a lower container to provide improved weight distribution and improved balance of the upper container.

Figure 7:
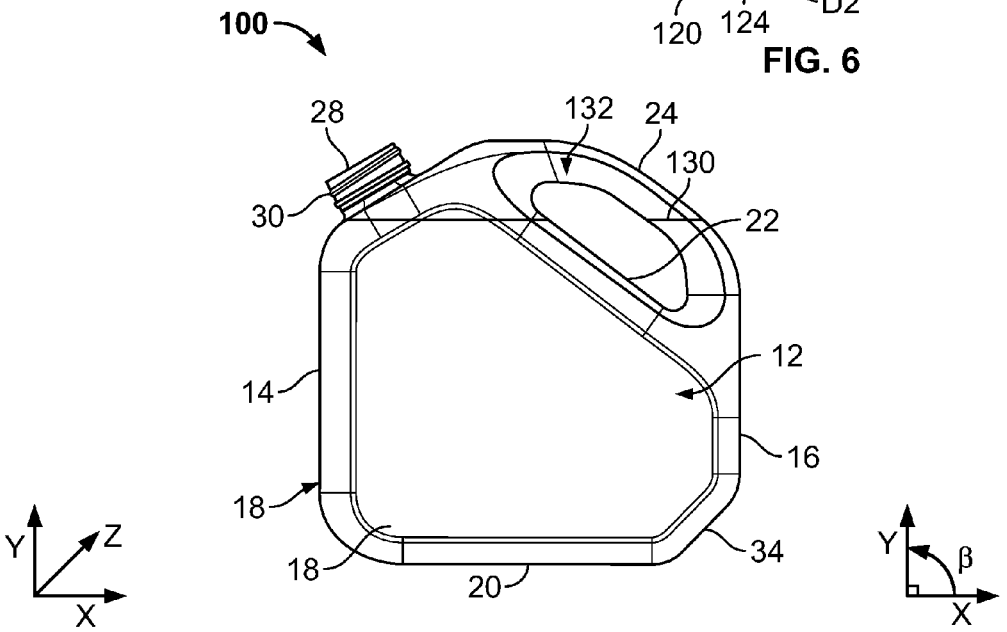
FIG. 7 is a left side elevational view of a container according to another embodiment.
Figure 8A:
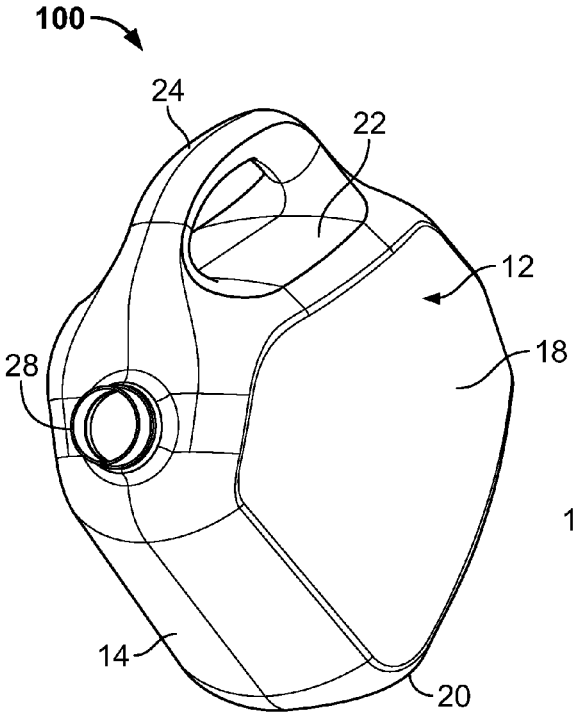
FIG. 8A is a front isometric view of a container according to another embodiment.
Figure 8B:
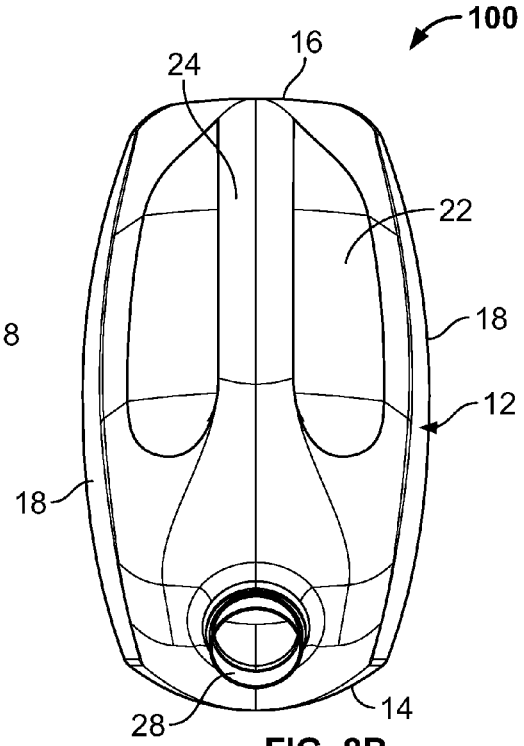
FIG. 8B is a top plan view of the container of FIG. 8A.
Figure 8C:
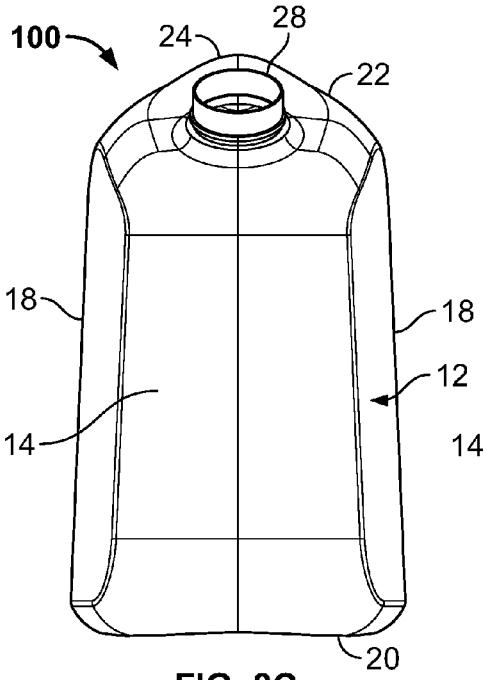
FIG. 8C is a front elevational view of the container of FIG. 8A.
Figure 8D:
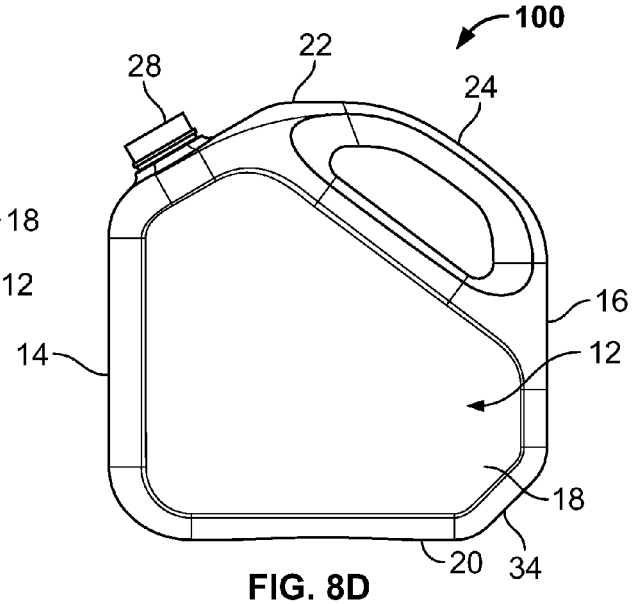
FIG. 8D is a left side elevational view of the container of FIG. 8A, the right side being a mirror image thereof.
Figure 9A:
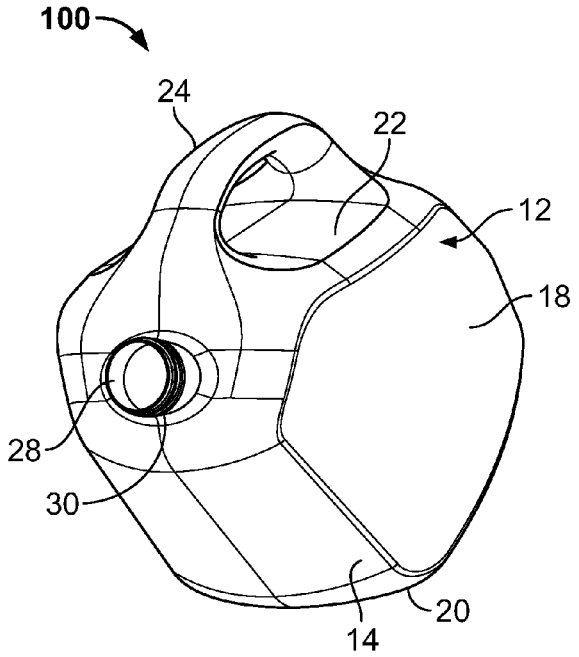
FIG. 9A is a front isometric view of a container according to another embodiment.
Figure 9B:
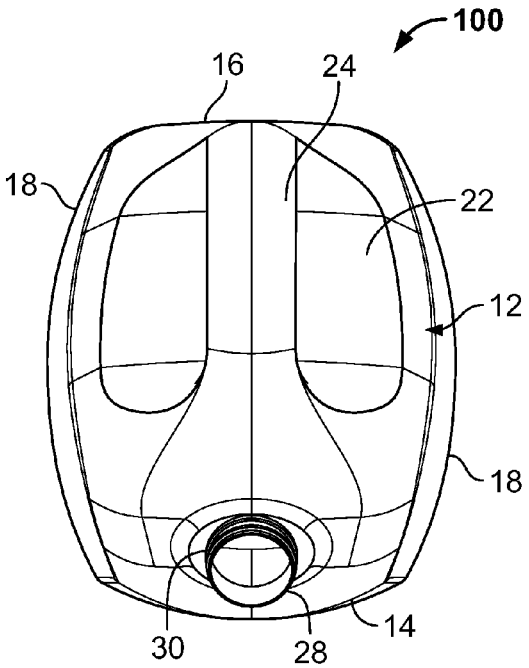
FIG. 9B is a top plan view of the container of FIG. 9A.
Figure 9C:
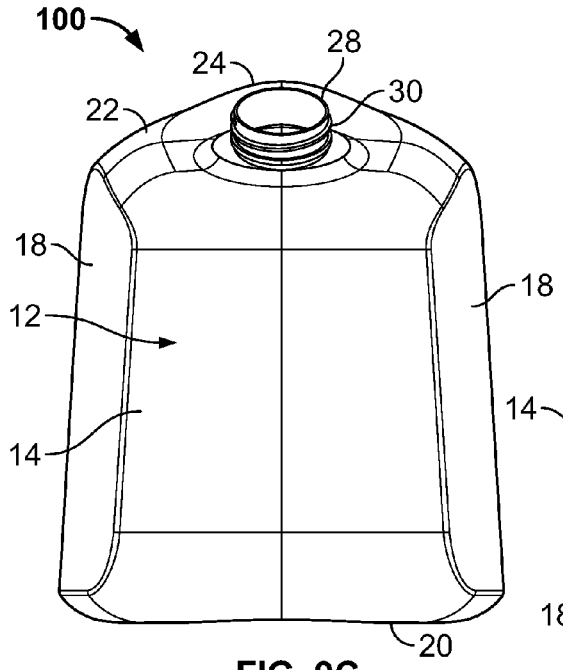
FIG. 9C is a front elevational view of the container of FIG. 9A.
Figure 9D:
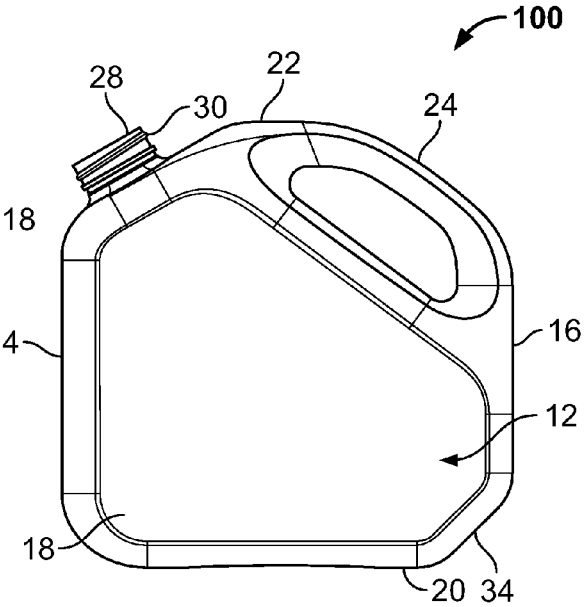
FIG. 9D is a left side elevational view of the container of FIG. 9A, the right side being a mirror image thereof.
Figure 10A:
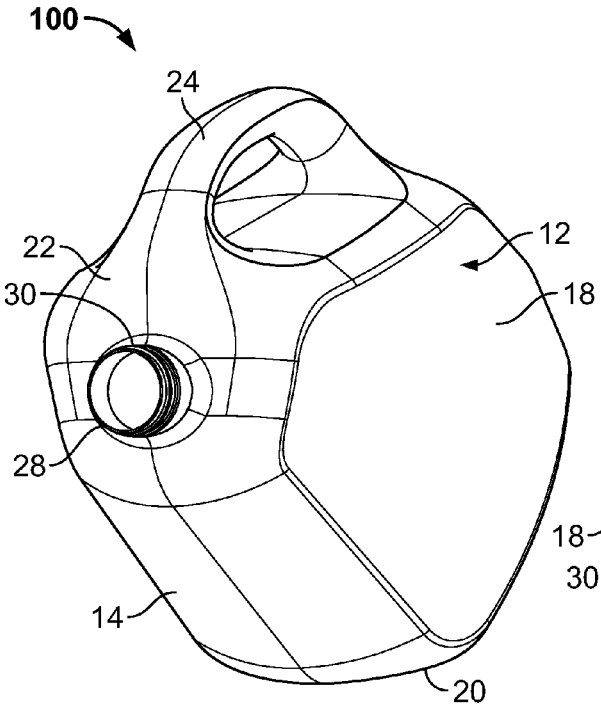
FIG. 10A is a front isometric view of a container according to another embodiment.
Figure 10B:
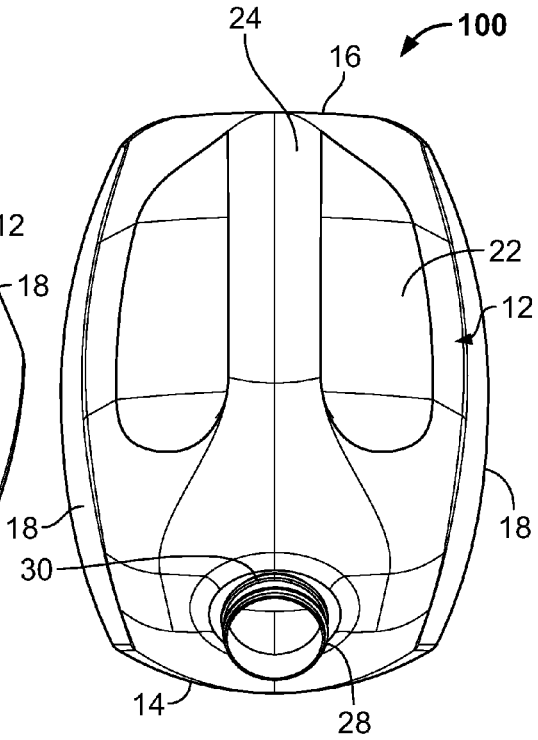
FIG. 10B is a top plan view of the container of FIG. 10A.
Figure 10C:
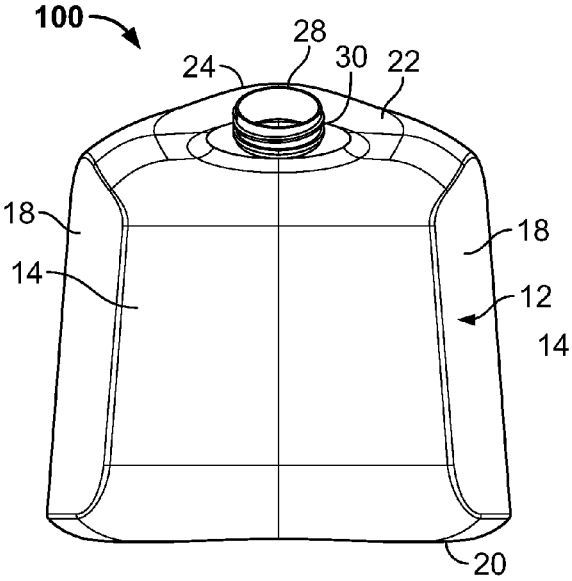
FIG. 10C is a front elevational view of the container of FIG. 10A.
Figure 10D:
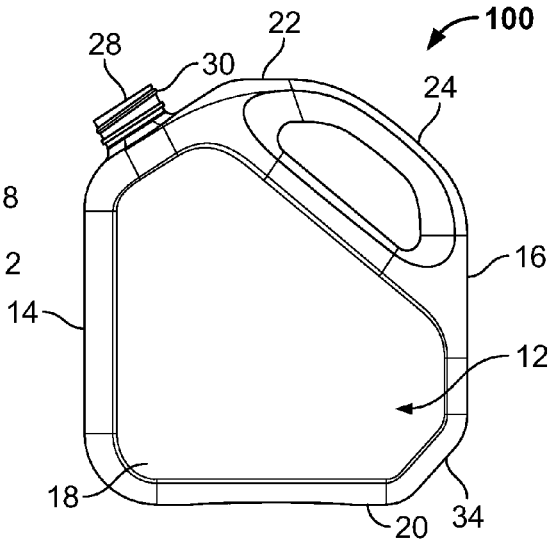
FIG. 10D is a left side elevational view of the container of FIG. 10A, the right side being a mirror image thereof.
Figure 11A:
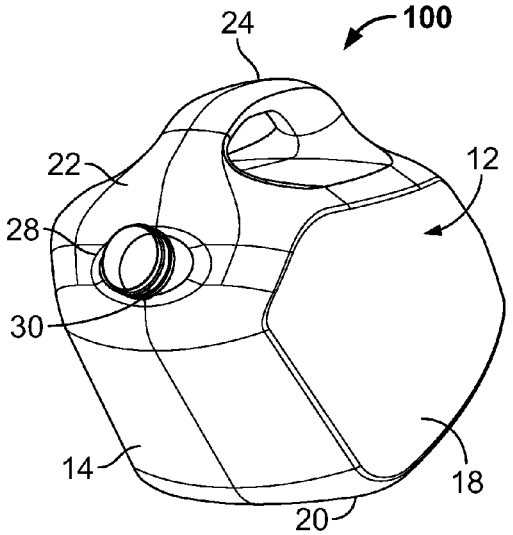
FIG. 11A is a front isometric view of a container according to another embodiment.
Figure 11B:
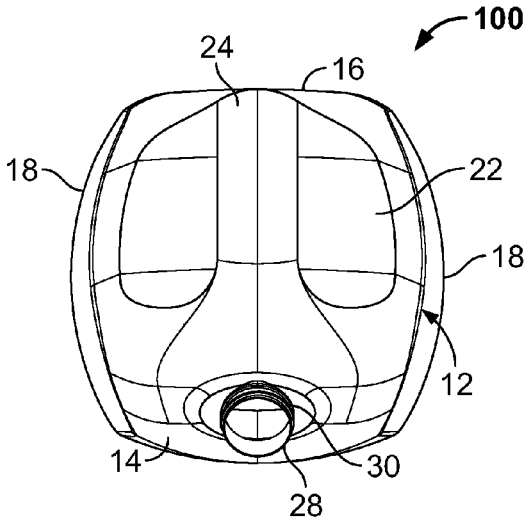
FIG. 11B is a top plan view of the container of FIG. 11A.
Figure 11C:
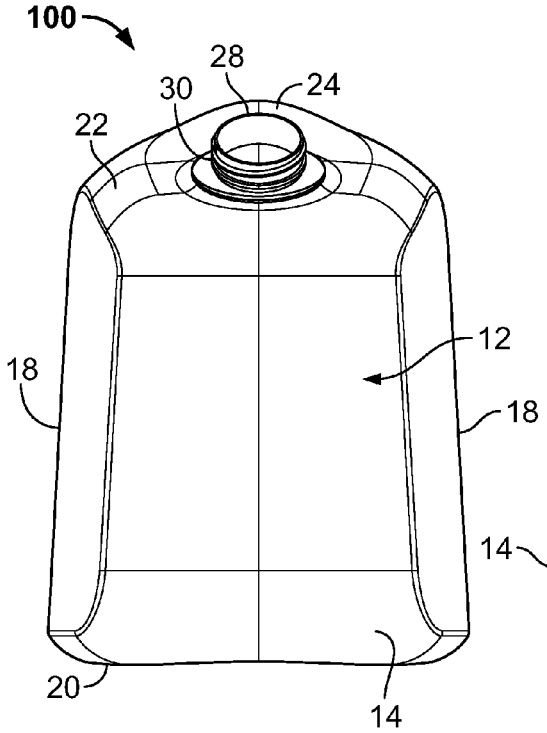
FIG. 11C is a front elevational view of the container of FIG. 11A.
Figure 11D:
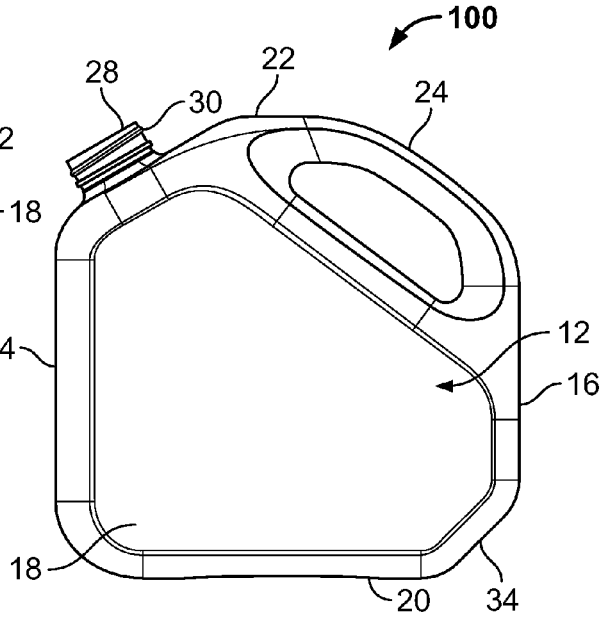
FIG. 11D is a left side elevational view of the container of FIG. 11A, the right side being a mirror image thereof.
Figure 12A:
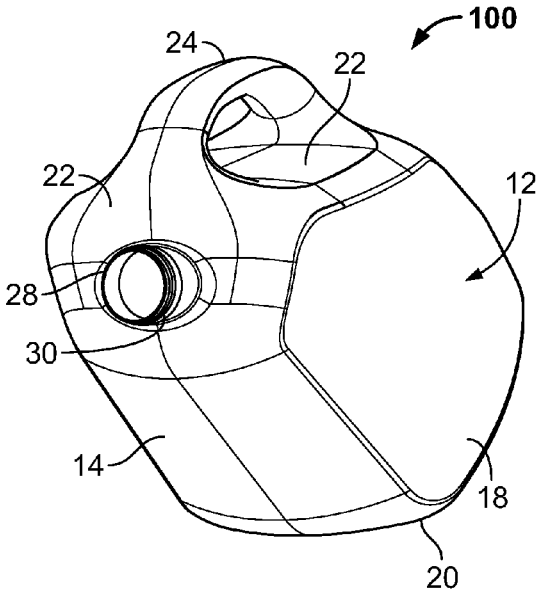
FIG. 12A is a front isometric view of a container according to another embodiment.
Figure 12B:
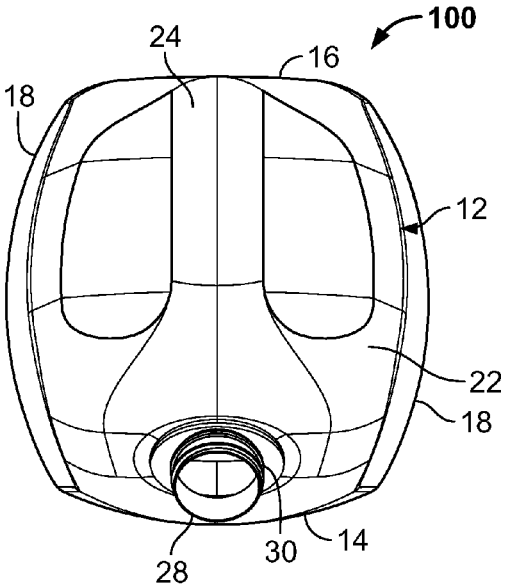
FIG. 12B is a top plan view of the container of FIG. 12A.
Figure 12C:
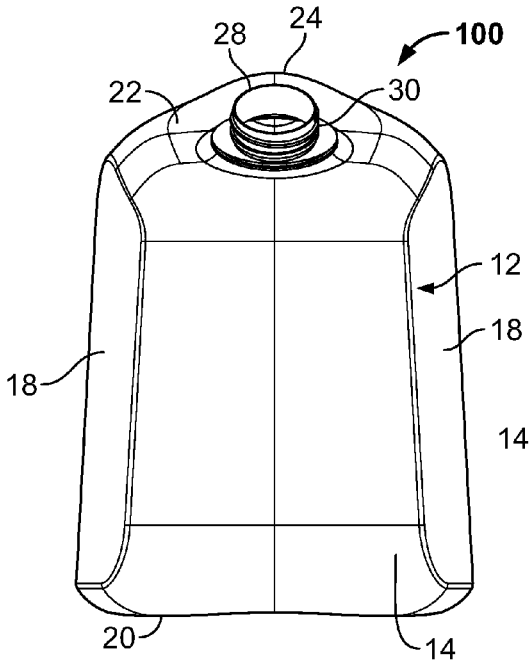
FIG. 12C is a front elevational view of the container of FIG. 12A.
Figure 12D:
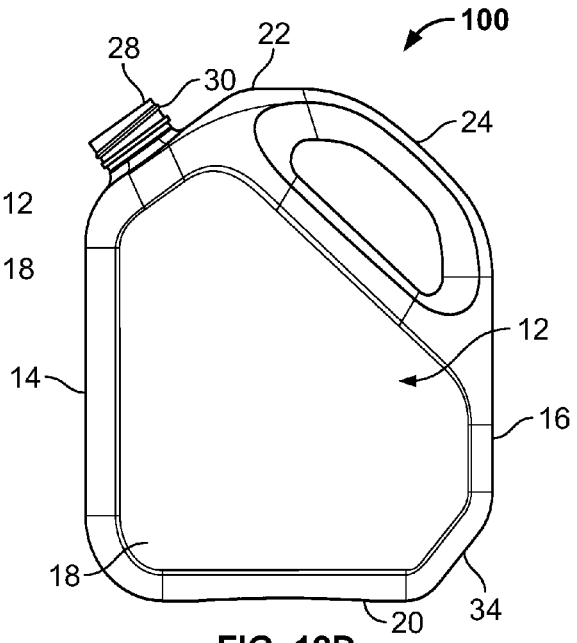
FIG. 12D is a left side elevational view of the container of FIG. 12A, the right side being a mirror image thereof.
Figure 13A:
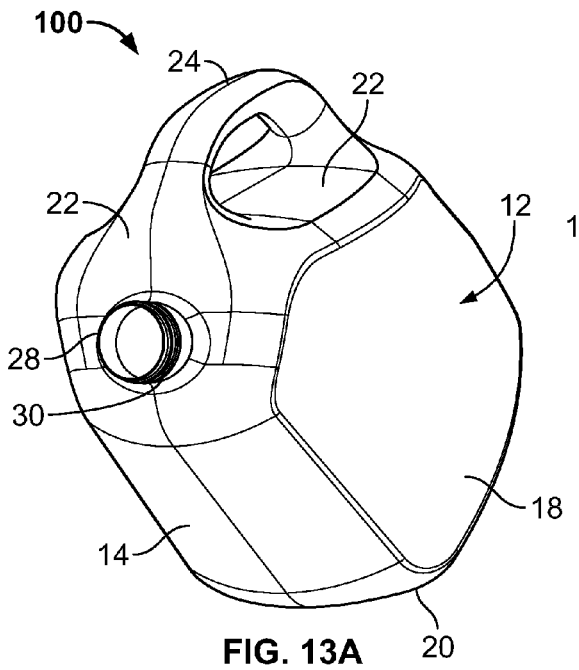
FIG. 13A is a front isometric view of a container according to another embodiment.
Figure 13B:
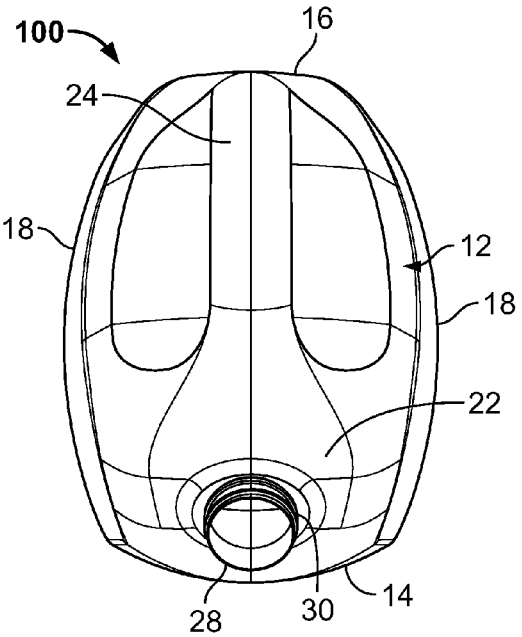
FIG. 13B is a top plan view of the container of FIG. 13A.
Figure 13C:
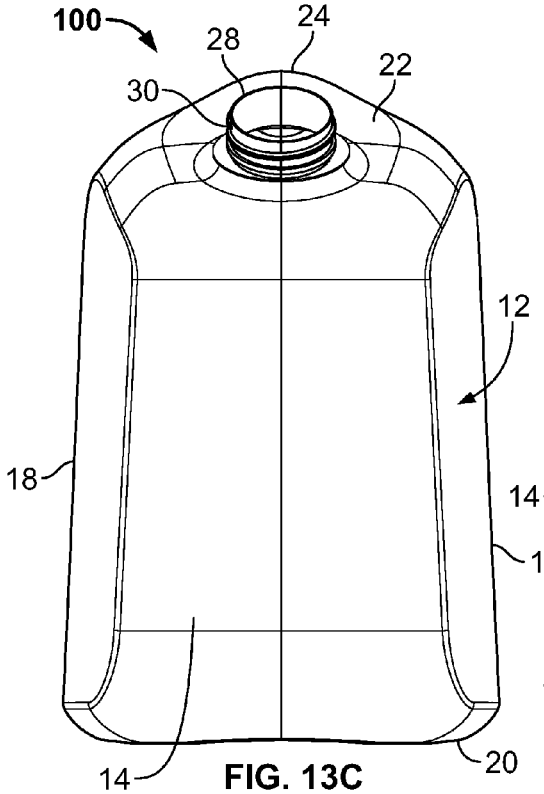
FIG. 13C is a front elevational view of the container of FIG. 13A.
Figure 13D:
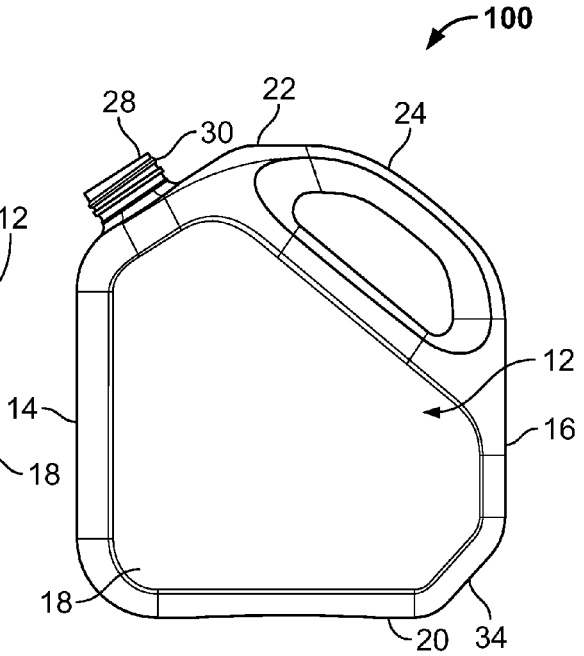
FIG. 13D is a left side elevational view of the container of FIG. 13A, the right side being a mirror image thereof.
Figure 14A:
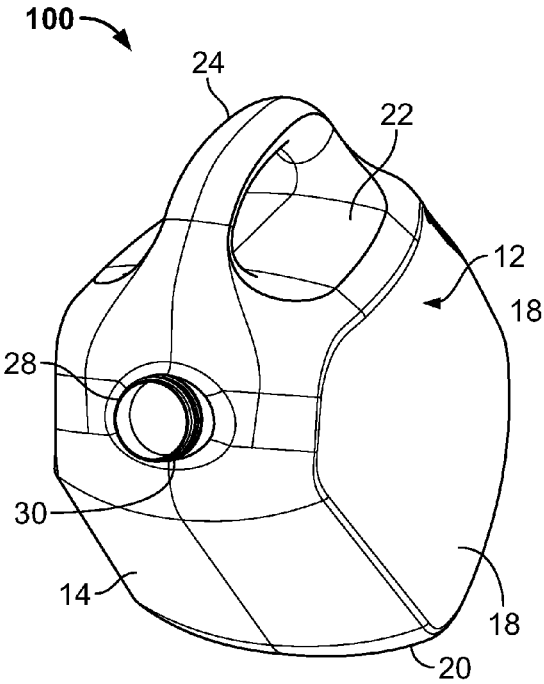
FIG. 14A is a front isometric view of a container according to another embodiment.
Figure 14B:
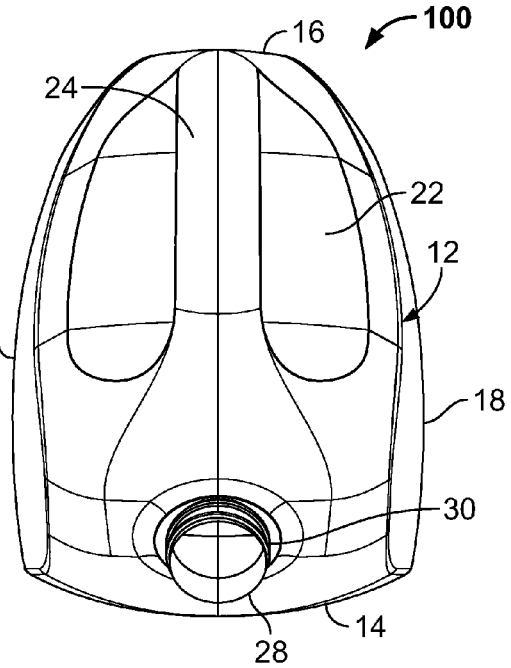
FIG. 14B is a top plan view of the container of FIG. 14A.
Figure 14C:
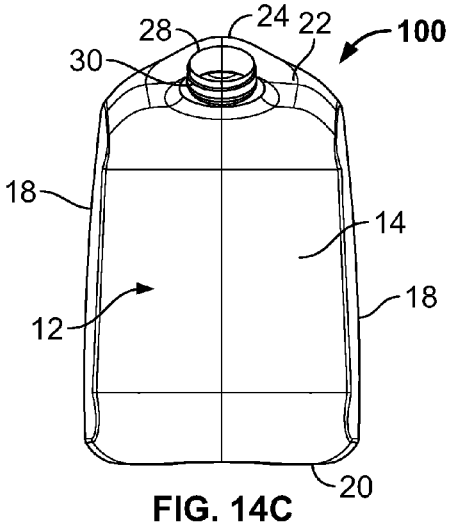
FIG. 14C is a front elevational view of the container of FIG. 14A.
Figure 14D:
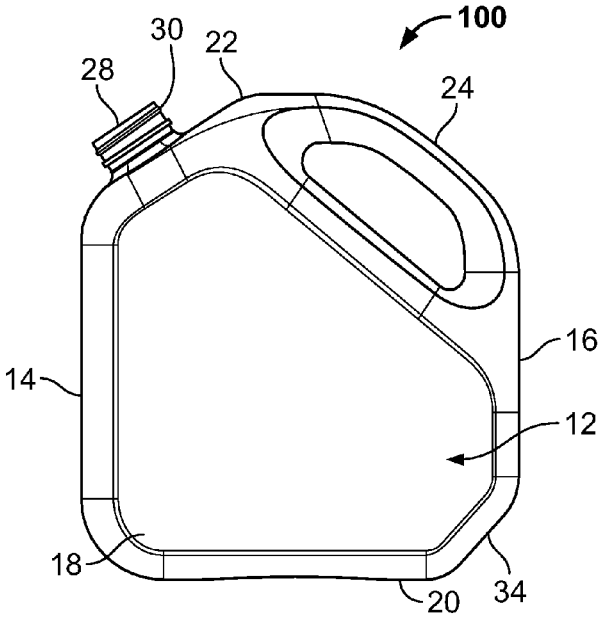
FIG. 14D is a left side elevational view of the container of FIG. 14A, the right side being a mirror image thereof.

In a further embodiment, variations in container dimensions (length, width, and height independently with respect to upper and lower portions of the containers), are envisioned that maximize use of internal container volume (for example, minimizing unusable head space) while at the same time minimizing changes in CG1 as the contents of the container are dispensed over time. For example, as seen in FIG. 7, a container 100 has a maximum fill height 130 above which is the unused head space or void volume 132. As further seen in FIGS. 8A-14D, subtle variations in container dimensions may be made that lead to optimized volume usage while maintaining ergonomics.

Table Nos. 1-5 below show that variations in container dimensions may be made to optimize use of total volume and fluid volume for 5 different container configurations. Containers A, B, C, D, and E are shown in FIGS. 8A-D, 9A-D, 10A-D, 11A-D, and 12A-D, respectively.

TABLE NO. 1

Container A - container volumes.

| | Fill Height (in/cm) | Total Volume ($in^3$/L) | Fluid Volume (gal/L) |
|---|---|---|---|
| Empty | 0/0 | 6.7/0.110 | 0/0 |
| 10% Usable HS | 6.4/16.25 | 222/3.64 | 0.93/3.5 |
| 0.5" Usable HS | 7/17.78 | 235.3/3.86 | 0.99/3.7 |
| 1 gallon | 7.1/18.03 | 237.0/3.88 | 1.00/3.8 |
| Max Fill (No Usable HS) | 7.5/19.05 | 243.7/3.99 | 1.03/3.9 |
| Unusable HS | 7.5/19.05 | 18.10/0.3 | 0.05/0.19 |

TABLE NO. 2

Container B - container volumes.

| | Fill Height (in/cm) | Total Volume ($in^3$/L) | Fluid Volume (gal/L) |
|---|---|---|---|
| Empty | 0/0 | 5.6/0.09 | 0/0 |
| 10% Usable HS | 6/15.24 | 219.4/3.6 | 0.93//3.5 |
| 0.5" Usable HS | 6.5/16.51 | 232.3/3.8 | 0.98/ |
| 1 gallon | 6.7/17.02 | 236.8/3.9 | 1.00/3.8 |
| Max Fill (No Usable HS) | 7/17.78 | 242.7/4.0 | 1.03/3.9 |
| Unusable HS | 7/17.78 | 18.40/0.3 | 0.06/0.23 |

TABLE NO. 3

Container C - container volumes.

| | Fill Height (in/cm) | Total Volume ($in^3$/L) | Fluid Volume (gal/L) |
|---|---|---|---|
| Empty | 0/0 | 5.4/0.09 | 0/0 |
| 10% Usable HS | 6.3/16 | 220/3.6 | 0.93/3.5 |
| 0.5" Usable HS | 7/17.78 | 235.7/3.9 | 1.00/3.8 |
| 1 gallon | 7/17.78 | 235.7/3.9 | 1.00/3.8 |
| Max Fill (No Usable HS) | 7.5/19.05 | 244.4/4.0 | 1.03/3.9 |
| Unusable HS | 7.5/19.05 | 17.0/0.3 | 0.05/0.19 |

TABLE NO. 4

Container D - container volumes

| | Fill Height (in/cm) | Total Volume ($in^3$/L) | Fluid Volume (gal/L) |
|---|---|---|---|
| Empty | 0/0 | 5.6/0.09 | 0/0 |
| 10% Usable HS | 5.85/14.86 | 220.4/3.6 | 0.93/3.5 |
| 0.5" Usable HS | 6.25/15.88 | 231.6/3.8 | 0.98/3.71 |
| 1 gallon | 6.45/16.38 | 236.6/3.9 | 1.00/3.8 |
| Max Fill (No Usable HS) | 6.75/17.15 | 243.1/4.0 | 1.03/3.9 |
| Unusable HS | 6.75/17.15 | 19.1/0.31 | 0.06/0.23 |

TABLE NO. 5

Container E - container volumes

| | Fill Height (in/cm) | Total Volume ($in^3$/L) | Fluid Volume (gal/L) |
|---|---|---|---|
| Empty | 0/0 | 4.7/0.08 | 0/0 |
| 10% Usable HS | 6.3/16 | 219.6/3.6 | 0.93/3.5 |

TABLE NO. 5-continued

| Container E - container volumes | | | |
|---|---|---|---|
| | Fill Height (in/cm) | Total Volume ($in^3$/L) | Fluid Volume (gal/L) |
| 0.5" Usable HS | 6.9/17.53 | 233.3/3.8 | 0.99/3.7 |
| 1 gallon | 7/17.78 | 235.3/3.9 | 1.00/3.8 |
| Max Fill (No Usable HS) | 7.4/18.8 | 242.5/4.0 | 1.03/3.9 |
| Unusable HS | 7.4/18.8 | 17.9/0.29 | 0.06/0.23 |

The variations in container dimensions of containers A-E are such that they do not compromise ergonomic considerations, as can be seen in Tables Nos. 6-10, which reveal changes in center of gravity per container relative to the X- and Y-axes (see FIG. 7) according to pour angle, β, which is the angle (expressed in degrees) between the bottom wall 20 and the X-axis as the container 100 rotates counterclockwise about the Z-axis to pour the contents from the pour spout 28. Changes in center of gravity are further influenced by total volume and fluid volume of container contents and the total mass of the container and contents 100.

TABLE NO. 6

| Container A - Change in center of gravity. | | | | | |
|---|---|---|---|---|---|
| Pour Angle (β) | Total Volume ($in^3$/L) | Fluid Volume (gal/L) | Pour CG-X (in/cm) | Pour CG-Y (in/cm) | Mass (lbs/kg) |
| 10 | 245.3/4.0 | 1.03/3.9 | 0.289/0.7 | 3.548/9.0 | 8.6/3.9 |
| 20 | 233.7/3.8 | 0.98/3.7 | 0.305/0.8 | 3.382/8.6 | 8.2/3.7 |
| 30 | 205.1/3.4 | 0.86/3.3 | 0.526/1.3 | 3.083/7.8 | 7.2/3.2 |
| 50 | 121.0/2.0 | 0.49/1.9 | 1.7/4.3 | 2.748/7.0 | 4.1/1.9 |
| 70 | 56.5/0.9 | 0.22/0.8 | 2.753/7.0 | 2.887/7.3 | 1.8/0.8 |
| 85 | 24.3/0.4 | 0.08/0.3 | 2.835/7.2 | 3.403/8.6 | 0.6/0.3 |
| 95 | 9.9/0.2 | 0.01/0.3 | 1.471/3.7 | 4.291/10.9 | 0.1/0.05 |

TABLE NO. 7

| Container B - Change in center of gravity. | | | | | |
|---|---|---|---|---|---|
| Pour Angle (β) | Total Volume ($in^3$/L) | Fluid Volume (gal/L) | Pour CG-X (in/cm) | Pour CG-Y (in/cm) | Mass (lbs/kg) |
| 10 | 245.6/4.0 | 1.06/4.0 | 0.289/0.7 | 3.565/9.1 | 8.9/4.0 |
| 20 | 233.4/3.8 | 1.01/3.8 | 0.303/0.8 | 3.409/8.7 | 8.4/3.8 |
| 50 | 117.3/1.9 | 0.51/1.9 | 1.585/4.0 | 2.825/7.2 | 4.2/1.9 |
| 70 | 53/0.9 | 0.23/0.9 | 2.543/6.5 | 2.931/7.4 | 1.9/0.9 |
| 85 | 21.4/0.4 | 0.09/0.4 | 2.627/6.7 | 3.408/8.7 | 0.8/0.4 |

TABLE NO. 8

| Container C - Change in center of gravity. | | | | | |
|---|---|---|---|---|---|
| Pour Angle (β) | Total Volume ($in^3$/L) | Fluid Volume (gal/L) | Pour CG-X (in/cm) | Pour CG-Y (in/cm) | Mass (lbs/kg) |
| 10 | 245.9/4.0 | 1.06/4.0 | 0.286/0.7 | 3.543/9.0 | 8.9/4.0 |
| 20 | 235.8/3.9 | 1.02/3.9 | 0.293/0.7 | 3.395/8.6 | 8.5/3.9 |
| 50 | 130.6/2.1 | 0.57/2.1 | 1.369/3.5 | 2.692/6.8 | 4.7/2.1 |
| 70 | 59.2/1.0 | 0.26/1.0 | 2.474/6.3 | 2.809/7.1 | 2.1/1.0 |
| 85 | 23/0.4 | 0.10/0.4 | 2.685/6.8 | 3.326/8.4 | 0.8/0.4 |

TABLE NO. 9

| Container D - Change in center of gravity. | | | | | |
|---|---|---|---|---|---|
| Pour Angle (β) | Total Volume ($in^3$/L) | Fluid Volume (gal/L) | Pour CG-X (in/cm) | Pour CG-Y (in/cm) | Mass (lbs/kg) |
| 10 | 246.7/4.0 | 1.07/4.0 | 0.288/0.7 | 3.574/9.1 | 8.9/4.0 |
| 20 | 234.2/3.8 | 1.01/3.8 | 0.302/0.8 | 3.426/8.7 | 8.5/3.8 |
| 50 | 116.0/1.9 | 0.50/1.9 | 1.517/3.9 | 2.871/7.3 | 4.2/1.9 |
| 70 | 51.9/0.9 | 0.22/0.9 | 2.401/6.1 | 2.968/7.5 | 1.9/0.8 |
| 85 | 21.1/0.3 | 0.09/0.3 | 2.463/6.3 | 3.427/8.7 | 0.8/0.3 |

TABLE NO. 10

| Container E - Change in center of gravity. | | | | | |
|---|---|---|---|---|---|
| Pour Angle (β) | Total Volume ($in^3$/L) | Fluid Volume (gal/L) | Pour CG-X (in/cm) | Pour CG-Y (in/cm) | Mass (lbs/kg) |
| 10 | 245.1/4.0 | 1.04/3.9 | 0.282/0.7 | 3.535/9.0 | 8.7/3.9 |
| 20 | 236.2/3.9 | 1.00/3.8 | 0.284/0.7 | 3.4/8.6 | 8.4/3.8 |
| 50 | 140.4/2.3 | 0.59/2.2 | 1.069/2.7 | 2.654/6.7 | 4.9/2.2 |
| 70 | 63.47/1.0 | 0.25/1.0 | 2.15/5.5 | 2.737/7.0 | 2.1/1.0 |
| 85 | 22.6/0.4 | 0.08/0.3 | 2.458/6.2 | 3.243/8.2 | 0.6/0.3 |

As can be seen in Table Nos. 6-10, a particular container's configuration influences the relationship between the amount of contents dispensed and the pour angle. For example, containers A, B, and D have dispensed more than 50% of total volume of their contents at pour angle of 50°, whereas containers C and E have dispensed less than 50% of total volume of their contents at pour angle of 50°. Additional relationships contemplated herein may be observed by comparison of any of pour angle, volumes, centers of gravity X and/or Y, and mass together with or independent from fill height, total volume, and fluid volume per container.

All values disclosed herein may vary by ±10%, ±20%, or ±50%.

INDUSTRIAL APPLICABILITY

The containers described herein advantageously provide an ergonomically favorable configuration to minimize user effort and discomfort when carrying or pouring liquids.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved. All patents and patent publications are incorporated by reference.

What is claimed is:

1. A container, comprising:

a reservoir having a front wall, a rear wall, side walls, a bottom wall, and a top wall, the reservoir further comprising an angled wall portion disposed opposite of a pour spout and angled relative to the bottom wall, the angled wall portion being configured to support the container with the pour spout in a generally vertical orientation during refilling of the reservoir, when the angled wall portion is placed on a horizontal surface;

a handle disposed on the top wall at an angle defined by a grip axis, the handle being configured for a single grip position and having a midpoint that coincides with a midpoint of a user's grip when the handle is gripped by a user;

a first center of gravity coincident with a resting axis that is substantially perpendicular to the bottom wall when the bottom wall is placed on a horizontal surface; and a second center of gravity coincident with a carrying axis that is substantially perpendicular to the grip axis when the container is carried by the handle.

2. The container of claim 1, wherein the pour spout disposed on the top wall adjacent the handle.

3. The container of claim 2 further comprising threads disposed on the pour spout.

4. The container of claim 3 further comprising a cap having threads complementary to the threads disposed on the pour spout, wherein the cap provides a liquid impervious seal.

5. The container of claim 1, wherein the pour spout extends from the top wall to a height (H1) below a height (H2) that corresponds to that of an upper most portion of the handle.

6. The container of claim 1, wherein the bottom wall comprises a concave central portion.

7. The container of claim 6, wherein the concave central portion of the bottom wall is configured to nest with the top wall of a second container to allow the containers to be stacked on top of one another.

8. The container of claim 1, wherein the resting axis and the carrying axis are separated by an angle ($\alpha$) ranging from about 15 to about 60 degrees.

9. The container of claim 1, wherein the container is comprised of at least one of a polymer, a plastic, metal, glass, a cellulosic material, a laminated material, a recycled material, and combinations thereof.

10. The container of claim 1 further comprising an interior and/or exterior lining and/or coating.

11. The container of claim 1, wherein the container has a maximum fill height of about 7 inches and a maximum fill volume of about 1 gallon.

12. The container of claim 11, wherein the container has a void volume of about 5%.

13. The container of claim 1 further comprising a liquid.

14. A container, comprising:

a reservoir having a top wall and a bottom wall configured to support the container in a generally vertical orientation when the bottom wall is placed on a horizontal surface;

a handle disposed entirely above the top wall at an angle defined by a grip axis, the handle being configured for a single grip position and having a midpoint that coincides with a midpoint of a user's grip when the handle is gripped by a user, wherein the top wall and the handle are disposed opposite the bottom wall when the bottom wall is placed on a horizontal surface;

a first center of gravity coincident with a resting axis that is substantially perpendicular to the bottom wall when the bottom wall is placed on a horizontal surface; and a second center of gravity coincident with a carrying axis that is substantially perpendicular to the grip axis when the container is carried by the handle, wherein the second center of gravity remains substantially coincident with the carrying axis as the contents of the container are dispensed from the reservoir.

15. The container of claim 14 further comprising at least one of a liquid and a particulate-based substance.

16. The container of claim 14, wherein the container dispenses more than 50% of a total volume of a liquid at a pour angle of 50°.

17. The container of claim 14, wherein the container has a generally square outline of 9.25"×9.25" (23.5 cm×23.5 cm) with a 5" (12.7 cm) base and rounded slightly tapered sides.

18. A container, comprising:

a reservoir having a front wall, a rear wall, side walls, a bottom wall, and a top wall;

a liquid comprised within the reservoir;

a handle disposed entirely above the top wall at an angle defined by a grip axis, the handle being configured for a single grip position and having a midpoint that coincides with a midpoint of a user's grip when the handle is gripped by a user;

a threaded pour spout disposed on the top wall adjacent the handle, the threaded pour spout and handle disposed opposite the bottom wall when the bottom wall is placed on a horizontal surface;

a cap disposed on the pour spout to provide a liquid impervious seal to the container;

a first center of gravity coincident with a resting axis that is substantially perpendicular to the bottom wall when the bottom wall is placed on a horizontal surface; and a second center of gravity coincident with a carrying axis that is substantially perpendicular to the grip axis when the container is carried by the handle, wherein the second center of gravity remains substantially coincident with the carrying axis as the contents of the container are dispensed from the reservoir.

19. The container of claim 18, wherein the container has a volume of about 1 pint, or about 1 to about 3 quarts, or about 1 to about 5 gallons, or about 500 ml to about 1 liter, or about 2 to about 10 liters.

* * * * *